US005842903A

United States Patent [19]

Messick

[11] Patent Number: 5,842,903

[45] Date of Patent: Dec. 1, 1998

[54] NOVELTY NOISE MAKING, ODOR GENERATING APPARATUS

[76] Inventor: John W. Messick, 17 Hunter La., Camp Hill, Pa. 17011

[21] Appl. No.: 858,932

[22] Filed: May 20, 1997

[51] Int. Cl.[6] ..... A63H 5/20; A63H 33/30; A63H 37/00

[52] U.S. Cl. ..... 446/213; 446/475; 446/491; 472/51; 428/905

[58] Field of Search ..... 406/213, 176, 406/268, 475, 491; 472/51, 52, 53, 56; 428/16, 905

[56] References Cited

U.S. PATENT DOCUMENTS

| | | | |
|---|---|---|---|
| D. 260,731 | 9/1981 | Sarac | 446/268 X |
| D. 299,694 | 2/1989 | Geiger . | |
| D. 346,018 | 4/1994 | Kawakami . | |
| 1,037,532 | 9/1912 | Redlich | 472/52 |
| 2,227,343 | 12/1940 | Haislip | 472/53 |
| 2,464,859 | 3/1949 | Gilowitz | 428/905 X |
| 2,618,892 | 11/1952 | Locks et al. | 446/268 |
| 2,807,901 | 10/1957 | Gilowitz | 428/905 X |
| 3,774,800 | 11/1973 | Lohwasser . | |
| 3,955,314 | 5/1976 | Robb | 446/268 X |
| 4,056,895 | 11/1977 | Terrulli | 446/475 |
| 4,905,898 | 3/1990 | Wade | 428/905 X |
| 5,037,343 | 8/1991 | Benites . | |
| 5,270,619 | 12/1993 | Iannini . | |

*Primary Examiner*—Robert A. Hafer
*Assistant Examiner*—D. Neal Muir
*Attorney, Agent, or Firm*—John D. Gugliotta

[57] ABSTRACT

A novelty noise making, odor generating Apparatus is provided having a clear beaker made of glass or plastic provides visual access to an interior volume. A removable stopper seals the interior volume of the beaker, which contains a colored gas having a humorously offensive odor. A base is provided for mounting the beaker in statue form, with a nameplate mounted thereto to provide a humorously offensive description of the colored gas. A stopper for providing fluid communication between the beaker's interior and exterior volumes is included forming an interior conduit and having a reed or bendable flap extends outward from the conduit wall to create an impediment to fluid flow through the conduit. When the stopper is placed into or removed from the beaker opening, the differential pressure created across the reed or bendable flap causes a momentary vibration, thereby generating an incremental noise.

7 Claims, 3 Drawing Sheets

NOVELTY NOISE MAKING, ODOR GENERATING APPARATUS

RELATED APPLICATIONS

The present invention is related to Disclosure Document Number 408,138 filed on Oct. 29, 1996.

BACKGROUND OF THE INVENTION

1. Field of the Invention

The present invention relates generally to humorous novelty items and, more particularly, to a novelty Apparatus that produces humorously offensive noises and odors.

2. Description of the Related Art

A search of the prior art did not disclose any patents that read directly on the claims of the instant invention; however, the following references were considered related:

| U.S. Pat. No. | Inventor | Issue Date |
|---|---|---|
| 5,270,619 | Iannini | Dec. 14, 1993 |
| 5,037,343 | Benites | Aug. 6, 1991 |
| 3,774,800 | Lohwasser | Nov. 27, 1973 |
| D346,018 | Kawakami | Apr. 12, 1994 |
| D299,694 | Geiger | Feb. 7, 1989 |

Of considerable importance in the related art are other novelty odor generating products. For example, in U.S. Pat. No. 5,037,343, issued in the name of Benites, a novelty scent simulating figure is provided for entertaining purposes in the form of a skunk-like figure with the tail member incorporating microcapsules containing scented liquid.

Other novelty air fresheners are known. Typical is depicted in U.S. Design Pat. No. Des. 346,018, issued in the name of Kawakami.

SUMMARY OF THE INVENTION

It is therefore an object of the present invention to provide an improved novelty noise producing statute.

Another object of the present invention is to provide an improved novelty odor producing Apparatus.

It is a feature of the present invention to provide such a novelty product that can serve as a humorous conversation piece, as well as being capable of easy manufacture.

Briefly described according to one embodiment of the present invention, a clear beaker made of glass or plastic provides visual access to an interior volume. A removable stopper seals the interior volume of the beaker, which contains a colored gas having a humorously offensive odor. A base is provided for mounting the beaker in statue form, with a nameplate mounted thereon to provide a humorously offensive description of the colored gas.

Another embodiment envisions a conduit formed within the stopper for providing fluid communication between the beaker's interior and exterior volumes. A reed or bendable flap extends outward from the conduit wall to create an impediment to fluid flow through the conduit. When the stopper is placed into or removed from the beaker open, the differential pressure created across the reed or bendable flap causes a momentary vibration, thereby generating an incremental noise having a humorously offensive auditory quality in concert with the ocular and olfactory aspects of the present invention.

The present invention is designed to provide a humorous novelty that can provide a nucleus for social conversation.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
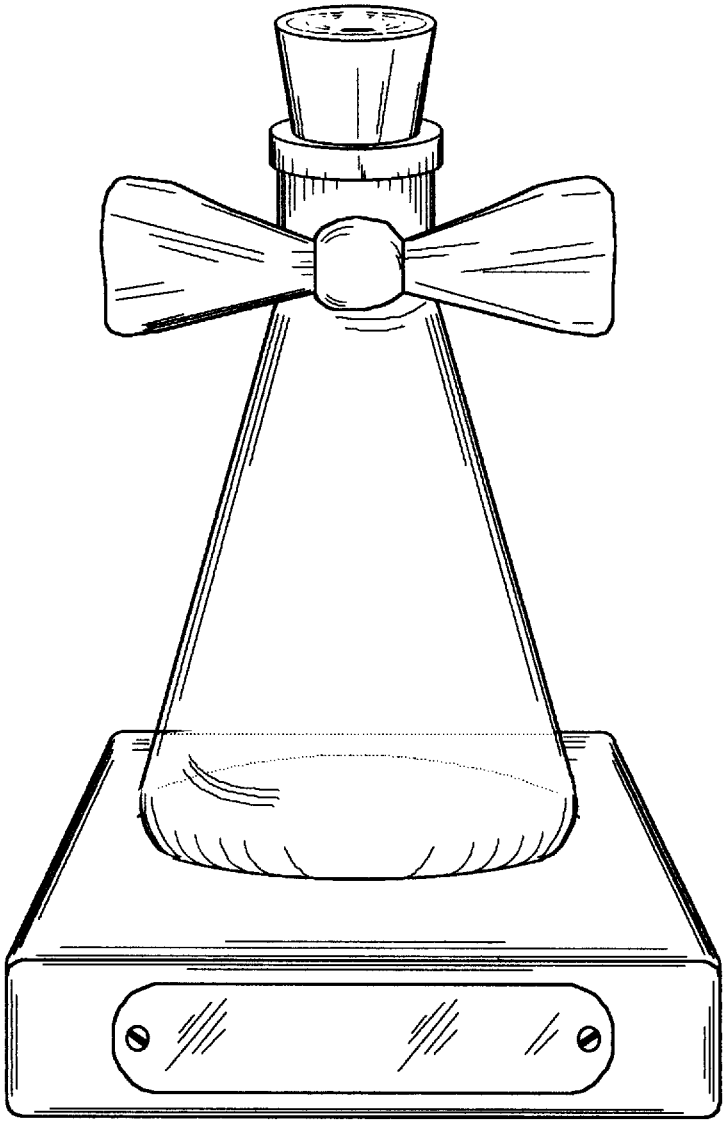
FIG. 1 is a perspective view of a novelty noise making and odor generating Apparatus according to one preferred embodiment of the present invention.
Figure 2:
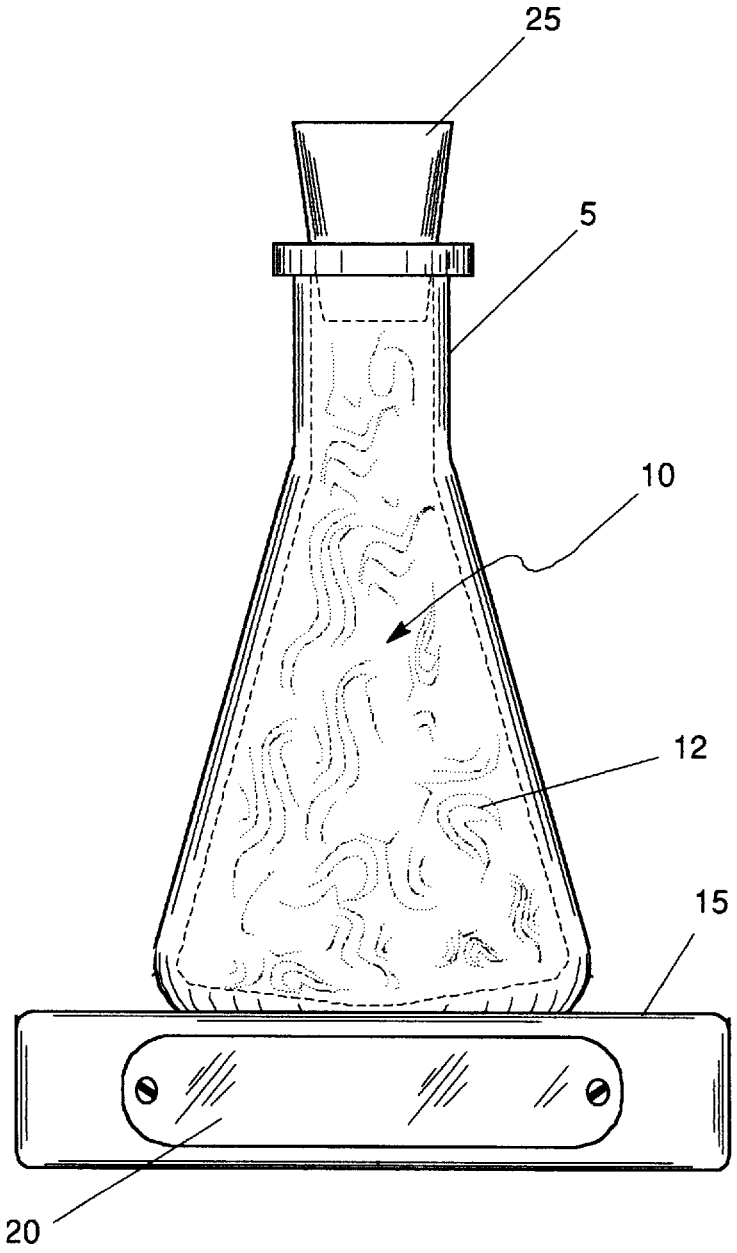
FIG. 2 is a front elevational view thereof.

Referring now to FIG. 1 and FIG. 2, a clear container 5 made of glass or plastic provides visual access to an interior volume, generally noted as 10. In its preferred embodiment it is felt that glass or other rigid, transparent material would provide visual access to the interior volume via a material that is inexpensive, effective, and readily available; however, it is envisioned that many other types of materials may be equally effective. As shown in the figures, a beaker having the shape of an Erlenmeyer flask, although other shapes (Dewar flask, round bottom flask, long or short neck flasks, or filter flask) and sizes can be used, affixed to a base 15. The base 15 provides lower ballast to the container 5 as well as supporting a nameplate 20.

It is envisioned that within the interior volume 10 is stored a gas 12 having different colors and/or smells in order to match different humorous names engraved upon the nameplate 20.

A removable stopper 25 seals the interior volume of the container 20, thereby containing the colored gas 12. It is envisioned that the gas 12 would possess a humorously offensive odor, such as that of intestinal gas. A base is provided for mounting the beaker in statue form, with a nameplate mounted thereto to provide a humorously offensive description of the colored gas.

Figure 3A:
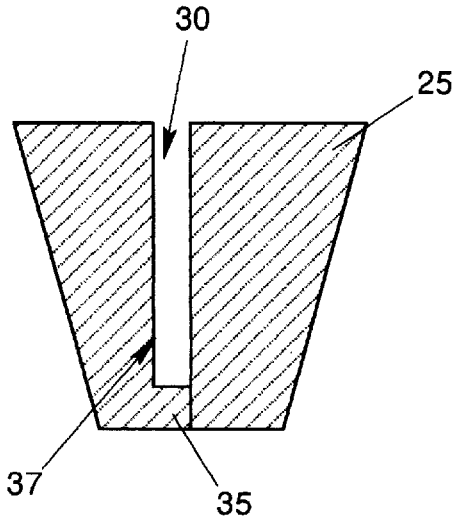
FIG. 3*a* is a cross sectional side elevational view taken along the axial centerline of a preferred embodiment of a stopper for use with the present invention.
Figure 3B:
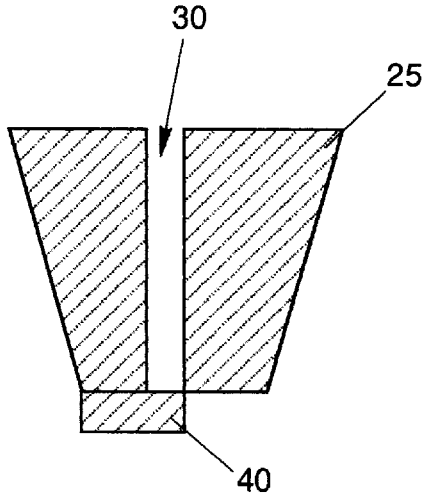
FIG. 3*b* is a cross sectional side elevational view of a stopper as otherwise described in FIG. 3*a* depicting and alternate embodiment thereof.

As shown in FIG. 3*a* and FIG. 3*b,* the removable stopper 25 forms a central conduit 30 formed within the stopper 25 for provide fluid communication between the container's interior volume 10 and it's exterior volume. In a first embodiment shown in FIG. 3*a,* a reed or bendable flap 35 extends outward from the conduit wall 37 to create an impediment to fluid flow through the conduit 30. When the stopper 25 is placed into or removed from the container's opening, the differential pressure created across the reed or bendable flap 25 causes a momentary vibration, thereby generating an incremental noise having a humorously offensive auditory quality in concert with the ocular and olfactory aspects of the present invention.

An alternate embodiment is envisioned as shown in FIG. 3*b.* Herein, the reed or bendable flap 35 is formed as a flat, flexible disc 40 affixed to the bottom portion of the stopper 25. The disc 40 extends outward across the lower opening of the conduit 30 to create the impediment to fluid flow through the conduit 30. When the stopper 25 is removed from the container's opening, the differential pressure created across the reed or bendable flap 25 causes a momentary vibration, thereby generating an incremental noise having a humorously offensive auditory quality in concert with the ocular and olfactory aspects of the present invention.

2. Operation of the Preferred Embodiment

In each embodiment, the combination of the humorous name or phrase located on the nameplate 20, the noxious gas 12 from the interior 10 of the container 5 simultaneously released in conjunction with the noise generated by stopper 25 provide a humorous novelty that can provide a nucleus for social conversation.

The foregoing description is included to illustrate the operation of the preferred embodiment and is not meant to limit the scope of the invention. The scope of the invention is to be limited only by the following claims.

What is claimed is:

1. A novelty noise making, odor generating apparatus comprising:

a clear container, said container having an opening and forming an interior volume and further providing visual access to said interior volume:

an visibly detectable, colored gas held within said interior volume, sad gas having a discernable odor, a base affixed to said container for providing lower ballast to said container;

a nameplate supported on said base; and a removable stopper for sealing the interior volume of said container, thereby containing said colored gas, and wherein said removable stopper further forms a central conduit defined by an cylindrical conduit wall and formed within said stopper for providing fluid communication between the container's interior volume and its exterior volume and wherein said stopper further comprises a bendable flap, said flap extending outward from said conduit wall thereby creating an impediment to fluid flow through the conduit.

2. The apparatus of claim 1, wherein said when said flap is bendable such as that when said stopper is placed into or removed from said opening, the differential pressure created across said flap causes a momentary vibration, thereby generating a momentary noise having a humorously offensive auditory quality.

3. A novelty noise making, odor generating apparatus comprising:

a clear container, said container having an opening and forming an interior volume and further providing visual access to said interior volume;

an visibly detectable colored gas held within said interior volume sad gas having a discernable odor;

a base affixed to said container for providing lower ballast to said container;

a nameplate supported on said base; and a removable stopper for sealing the interior volume of said container, thereby containing said colored gas, and wherein said removable stopper further forms a central conduit formed within said stopper for providing fluid communication between the container's interior volume and its exterior volume and wherein said stopper further comprises a bendable flap formed as a flat, flexible disc, said disc being affixed to the bottom portion of said stopper such that said disc extends outward across the lower opening of the conduit to create an impediment to fluid flow through the conduit.

4. The apparatus of claim 3, wherein said when said flap is bendable such as that when said stopper is placed into or removed from the container's opening, the differential pressure created across said flap causes a momentary vibration, thereby generating a momentary noise having a humorously offensive auditory quality.

5. A novelty noise making, odor generating apparatus comprising:

a clear container, said container having an opening and forming an interior volume and further providing visual access to said interior volume;

an visibly detectable, colored gas held within said interior volume, sad gas having a discernable odor; and a removable stopper for sealing the interior volume of said container, thereby containing said colored gas, and wherein said removable stopper further forms a central conduit defined by an cylindrical conduit wall and formed within said stopper for providing fluid communication between the container's interior volume and its exterior volume and wherein said stopper further comprises a bendable flap, said flap extending outward from said conduit wall thereby creating an impediment to fluid flow through the conduit.

6. The apparatus of claim 5, wherein said when said flap is bendable such as that when said stopper is placed into or removed from said opening, the differential pressure created across said flap causes a momentary vibration, thereby generating a momentary noise having a humorously offensive auditory quality.

7. A novelty noise making, odor generating apparatus comprising:

a clear container, said container having an opening and forming an interior volume and further providing visual access to said interior volume;

an visibly detectable, colored gas held within said interior volume, sad gas having a discernable odor; and a removable stopper for sealing the interior volume of said container, thereby containing said colored gas, and wherein said removable stopper further forms a central conduit formed within said stopper for providing fluid communication between the container's interior volume and its exterior volume and wherein said stopper further comprises a bendable flap formed as a flat, flexible disc, said disc being affixed to the bottom portion of said stopper such that said disc extends outward across the lower opening of the conduit to create an impediment to fluid flow through the conduit.

* * * * *